US007024012B2

(12) United States Patent
Olsen

(10) Patent No.: US 7,024,012 B2
(45) **Date of Patent: *Apr. 4, 2006**

(54) COMPACT MODULAR IN-THE-EAR HEARING AID

(75) Inventor: Jørgen Mejner Olsen, Hillerød (DK)

(73) Assignee: Widex A/S, Vaerloese (DK)

( * ) Notice: Subject to any disclaimer, the term of this patent is extended or adjusted under 35 U.S.C. 154(b) by 154 days.

This patent is subject to a terminal disclaimer.

(21) Appl. No.: 10/720,093

(22) Filed: Nov. 25, 2003

(65) Prior Publication Data

US 2004/0105561 A1 Jun. 3, 2004

Related U.S. Application Data

(63) Continuation of application No. 10/209,940, filed on Aug. 2, 2002, now Pat. No. 6,678,385, which is a continuation of application No. 09/254,260, filed on Mar. 4, 1999, now Pat. No. 6,430,296.

(30) Foreign Application Priority Data

Apr. 15, 1997 (DK) ..... 0421/97

(51) Int. Cl.
*H04R 25/00* (2006.01)

(52) U.S. Cl. ..... 381/322; 381/323; 381/328; 29/896.21

(58) Field of Classification Search ..... 381/322–324, 381/328; 181/128–130; 29/896.21
See application file for complete search history.

(56) References Cited

U.S. PATENT DOCUMENTS 4,598,177 A 7/1986 McGroarty et al.
4,680,799 A 7/1987 Henneberger
4,716,985 A 1/1988 Haertl
4,739,512 A 4/1988 Hartl et al.
4,870,688 A 9/1989 Voroba et al.
5,201,008 A 4/1993 Arndt et al.
5,257,315 A 10/1993 Haertl et al.
5,347,584 A 9/1994 Narisawa
5,790,672 A 8/1998 Klostermeier
5,889,874 A 3/1999 Schmitt et al.
5,995,636 A 11/1999 Topholm
6,430,296 B1 * 8/2002 Olsen ..... 381/322

(Continued)

FOREIGN PATENT DOCUMENTS

CH 683811 A5 5/1994

(Continued)

*Primary Examiner*—Suhan Ni
(74) *Attorney, Agent, or Firm*—Sughrue Mion, PLLC

(57) ABSTRACT

A modular hearing aid for arrangement in a user's ear comprises a hollow plug (1) adapted to the ear canal and having a generally irregular conical shape and an exterior opening which is covered by a faceplate (2), in which a recess (8) is formed for removable arrangement of a battery (23) as well as an electronic module (4) comprising a microphone part (5), a signal processing part (6) and a sound reproducer (7). The recess (8) comprises a first region (9) for insertion of the battery (23) and a second region (10) coherent with the first region for placing of a socket part (11) of the electronic module (4), and at the edge of the recess (8) the faceplate (2) is formed with engaging means (12–16) for the socket part (11), whereas further parts of the electronic module (4) are placed below the faceplate (2). The recess (8) is formed such that at removal of the battery (23) the first and second regions (9, 10) together allow passage also of said further parts (6,7) for removal of the complete electronic module.

28 Claims, 4 Drawing Sheets

U.S. PATENT DOCUMENTS 6,678,385 B1 * 1/2004 Olsen ..... 381/322

FOREIGN PATENT DOCUMENTS

DE 4121311 C1 8/1992
DE 4444586 C1 2/1996
EP 0311233 A2 4/1989
GB 2118397 A 10/1983

* cited by examiner

COMPACT MODULAR IN-THE-EAR HEARING AID

This is a continuation of application Ser. No. 10/209,940 filed on Aug. 2, 2002 now U.S. Pat. No. 6,678,385, which is a continuation of application Ser. No. 09/254,260 filed Mar. 4, 1999; now U.S. Pat. No. 6,430,296, which is a 371 of PCT/DK98/00148, filed Apr. 8, 1998, the disclosures of which are incorporated herein by reference.

BACKGROUND OF THE INVENTION

The present invention relates to a modular hearing aid for arrangement in a user's ear, particularly completely inside the ear canal, comprising a hollow plug adapted to the ear canal and having a generally irregular conical shape and an outward opening which is covered by a faceplate in which a recess is formed for removable arrangement of a battery as well as an electronic module comprising a microphone, a signal processing part and a sound reproducer.

While conventional hearing aids in a so-called BTE design for arrangement behind a user's ear are usually manufactured with a housing of a size that allows relatively easy separation for replacement of battery and possibly removal of electronic components for repair, etc., hearing aids of the above designs, i.e., of a so-called ITE design for arrangement in the ear, normally in the funnel-shaped outer part of the ear canal, or of a so-called CIC design for arrangement completely inside the ear canal, require a very compact design of the housing or plug of the hearing aid to allow it partly to be arranged in the ear canal, partly to house the components necessary for operation of the hearing aid, such as battery and electronic components for sound reception, signal processing and sound reproduction.

For manufacturing reasons, such hearing aids are therefore normally built up by joining together a plug or shell, which is adapted in shape and dimensions to the ear canal of the actual user and has an external faceplate to which the electronic components are glued or otherwise fastened so that by gluing of the faceplate to the user-adapted plug or shell they are localized therein in a protected manner. In conventional hearing aids of this type, such as are known from, e.g., EP A2-0 311 233 and U.S. Pat. No. 4,680,799, it is therefore usually necessary in connection with replacement or repair of electronic components to break the shell or the faceplate by milling or in any other way, which renders repairs difficult and more expensive and means that the shell and/or the faceplate must be re-established after repair.

An attempt has been made to alleviate the disadvantages connected with this by means of a hearing aid design known from DE-C1-41 21 311, in which the microphone part and the signal processing part of an electronic module are placed together with the battery in an insert part for removable mounting in the faceplate.

This insert part or mounting plate is, however, relatively large compared with the overall size of the faceplate and therefore requires a corresponding increase of the size of the recess, which limits the possibilities of final adaptation of the external contour of the faceplate, for example by buffing in connection with joining the faceplate with the user-adapted shell or plug, to an undesired degree. Further-more, the manufacturing of these known hearing aids is made more complicated and expensive by the requirement for a separate insert part or mounting plate for the electronic components.

In another design known from U.S. Pat. No. 5,201,008, an electronic module is removably fastened in a faceplate, here constituted by a rim portion at the external orifice of the user-adapted plug or shell, which is closed in its entirety by a hinge-connected lid. This apparatus design is substantially more complex and expensive due to the need for a separate holder for the electronic module and a complicated lid design.

SUMMARY OF THE INVENTION

From this point of departure, the object of the invention is to provide a hearing aid of the type stated, in which the possibility of a non-destructive removal of the electronic module from the hearing aid housing is obtained without any noticeable limitation of the possibilities of final adaptation of the outer contour of the faceplate to a user-adapted ear canal plug or shell.

To obtain this, the modular hearing aid according to the invention is characterized in that the recess comprises a first region for insertion of the battery and a second region coherent with the first region for placing of a socket part of the electronic module, while further parts thereof are placed below the faceplate, that at the edge of the recess the faceplate is formed with engaging means for said socket part, and that the recess is formed so that at removal of the battery the first and second regions together allow passage also of said further parts for removal of the complete electronic module.

Through said design of the recess in the faceplate, whereby the faceplate only has to retain a less space-consuming part of the aggregate electronic module in the form of said socket part, which may, for example, comprise only the microphone part, which has to lie close to the faceplate in consideration of reception of the sound, the intended removability of the electronic module can be obtained without any marked increase of the size of the recess compared with what is required in consideration of replacement of the battery.

Advantageous embodiments and features of the invention appear from the dependent claims.

BRIEF DESCRIPTION OF THE DRAWINGS

The invention will now be explained in more detail below with reference to the schematic drawing, in which.

DETAILED DESCRIPTION OF THE INVENTION

Figure 1:
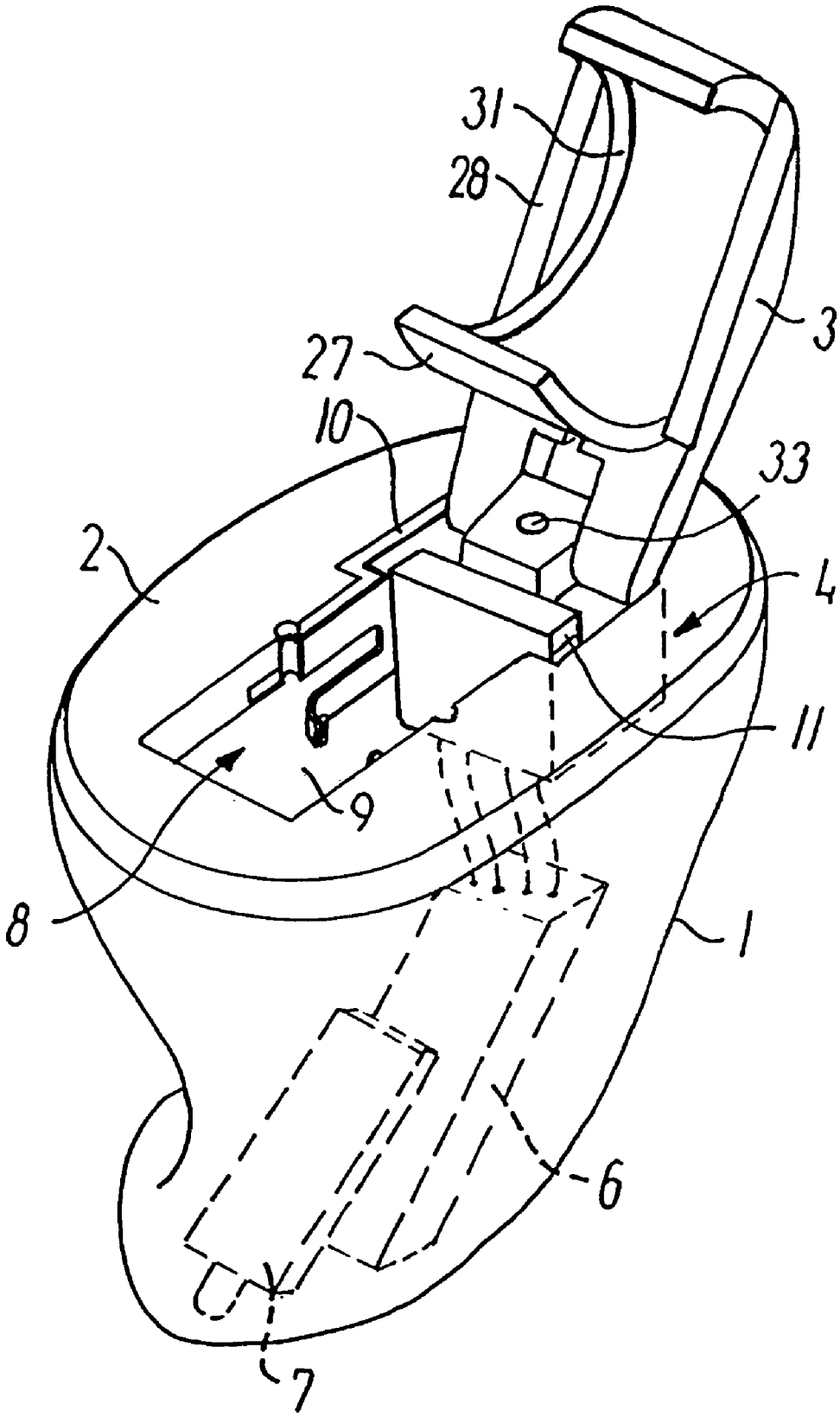
FIG. 1 is a perspective view of an embodiment of a modular hearing aid according to the invention.

The embodiment shown in FIG. 1 of a so-called ITE hearing aid for arrangement in the user's ear canal comprises a hollow plug 1 adapted to the ear canal and having a generally irregular conical shape, an external faceplate 2 covering the outward opening of the plug 1, a battery lid 3 pivotally connected with the faceplate 2, and an electronic module 4 having a microphone 5, a signal processing part 6 and a sound reproducer in the form of a receiver 7.

At the narrow end, which faces the interior of the ear canal during use, the plug 1 is formed with a sound exit hole, not shown, through which sound produced by the receiver 7 can be passed on to the interior of the ear.

Figure 2:
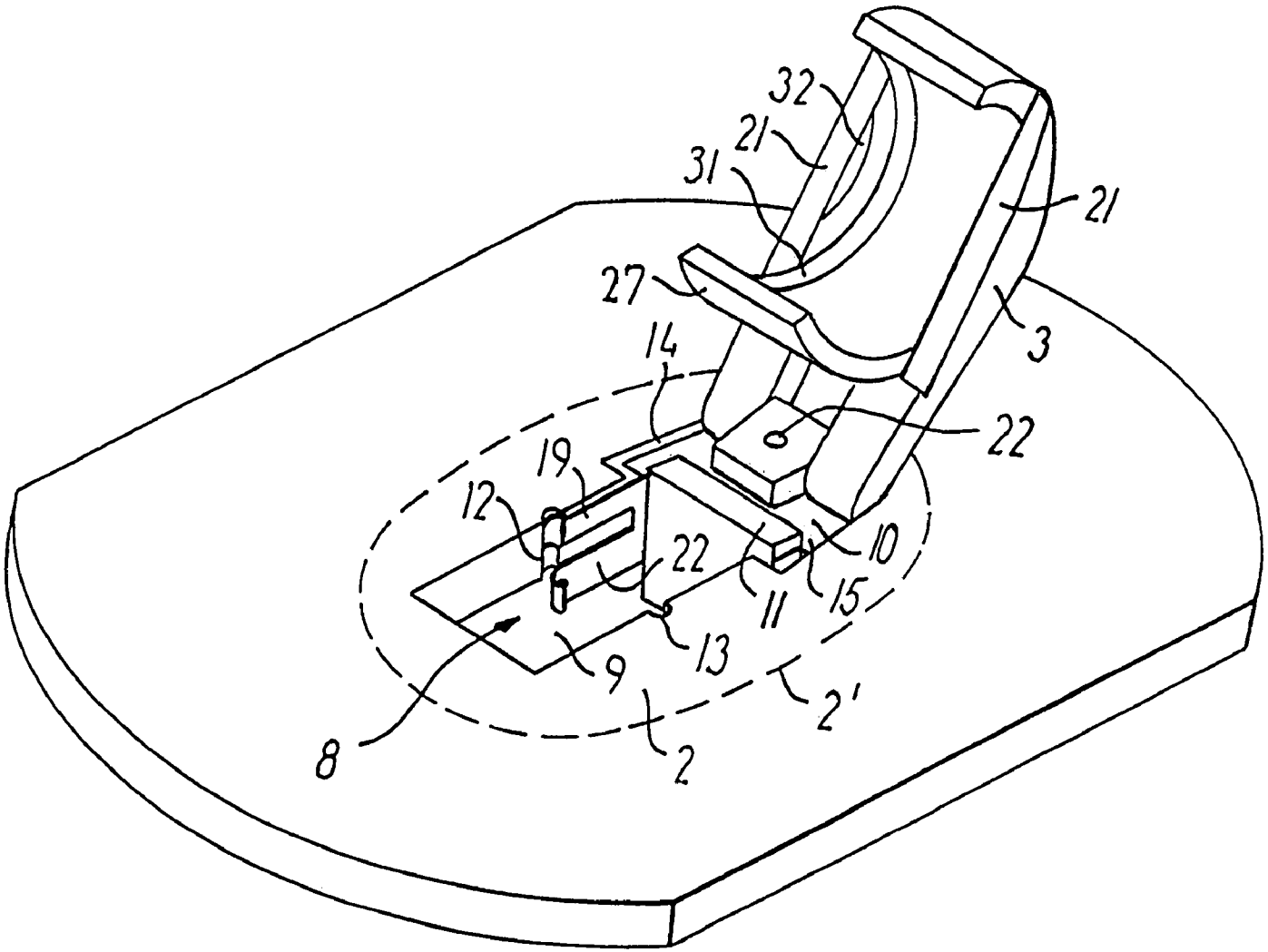
FIG. 2 is a perspective view of a faceplate for use in the hearing aid of FIG. 1 with an inserted electronic module and a battery lid connected with the faceplate.
Figure 3:
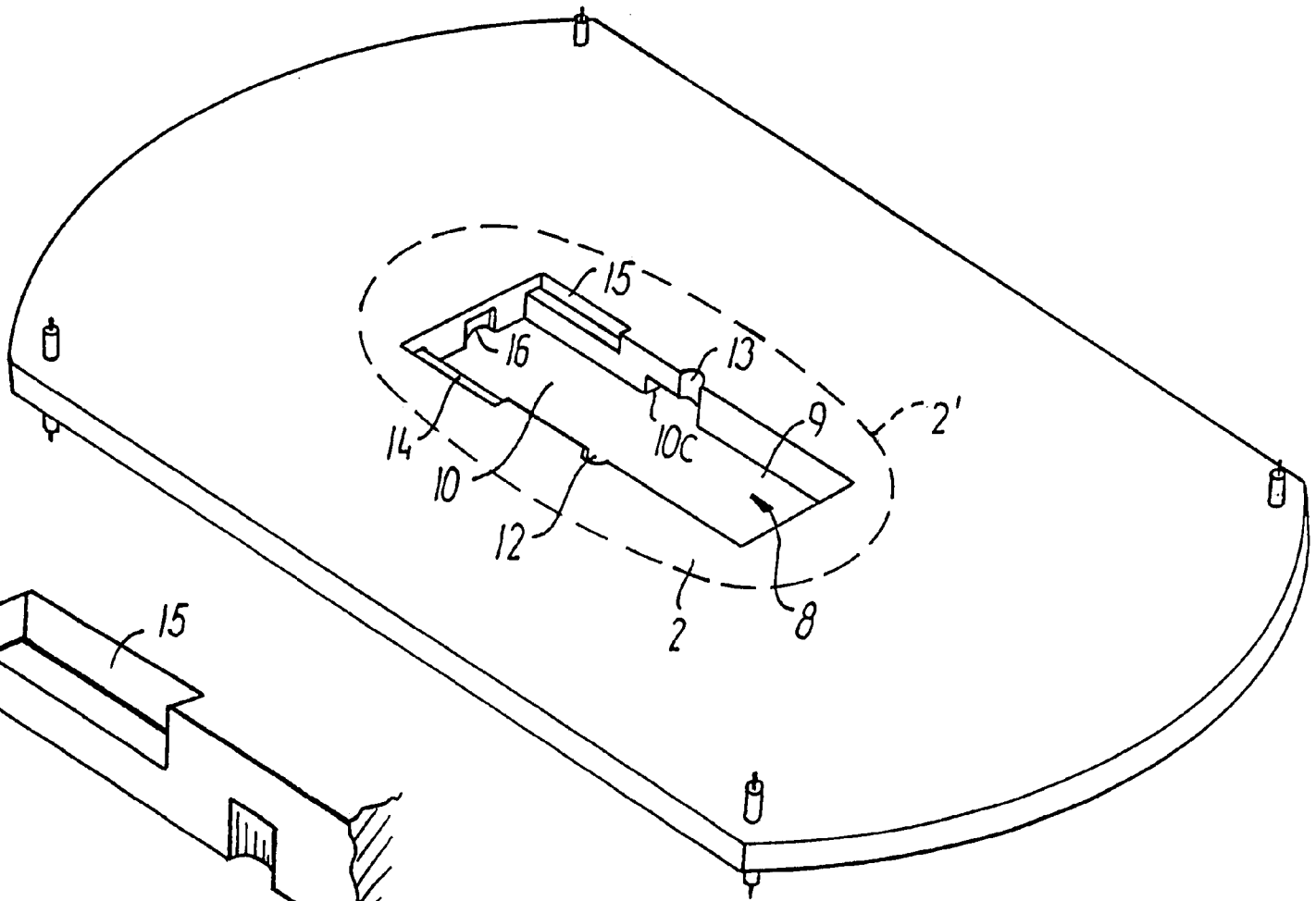
FIG. 3 is a perspective view of the faceplate itself.

When a hearing aid is adapted to a user's ear, the shape of the plug 1 is usually individually adapted to the ear canal, but the plug 1 may, however, also be manufactured as a standard component. The faceplate 2, which is usually a standard component and may be formed as shown in FIGS. 2 and 3, is then glued over the outward opening of the plug 1. After gluing, the contour of the faceplate 2 is then formed by cutting or milling according to the contour of the edge of the orifice of the plug 1, as marked by a dashed line 2' in FIG. 2. After finishing of the plug 1 with the glued-on and contour-adapted faceplate 2, the other components are mounted in the hearing aid, which provides the manufacturing advantage that the plug 1 with the faceplate 2 can be cleaned after the finishing so that the other components are not exposed to pollution during their mounting.

Figure 11:
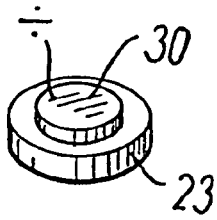
FIG. 11 is an example of a hearing aid battery for use in the hearing aid of FIG. 1.

As shown in FIGS. 1–3, a recess 8 is formed in the faceplate 2 for removable arrangement of a battery, which may be formed as shown in FIG. 11 and is inserted in the lid 3, formed as a battery holder, as well as the electronic module 4. For this purpose, the recess 8 comprises a first region 9 for positioning of the battery and a second region 10 coherent therewith for insertion of a socket part 11 of the electronic module 4, which houses the microphone part 5 of the module.

To retain the socket part 11 of the electronic module 4, integral engaging means are formed at the edge of the recess 8, as shown in FIGS. 2 and 3, and, in the embodiment shown, comprise a pair of grooves 12 and 13 which are arranged opposite to each other at opposite edges of the recess 8 in the first region 9 for positioning of the battery. These grooves 12 and 13 serve to retain the socket part 11 against displacement in the plane of the faceplate 2. The engaging means further comprise a pair of tracks 14 and 15 facing each other for retention of the socket part 11 against displacement at right angles to the faceplate 2 into the plug 1 and a notch 16 for retention of the socket part 11 against displacement in the opposite direction.

Figure 6:
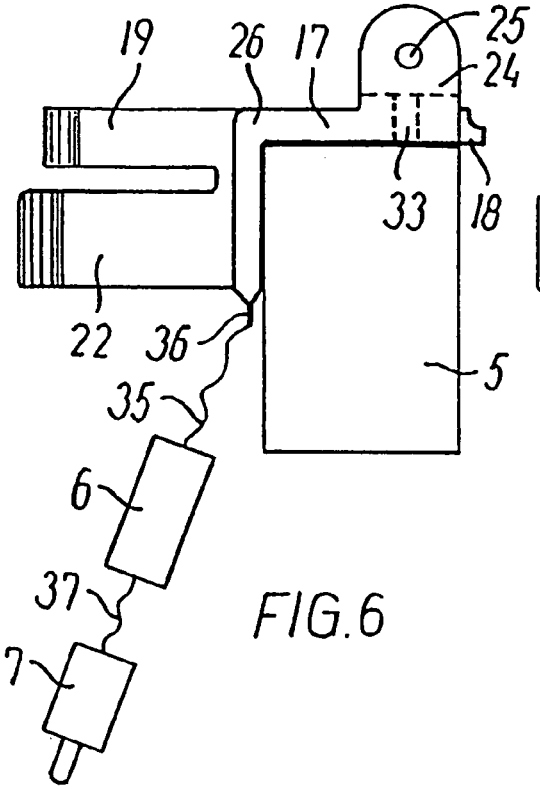
FIGS. 6 and 7 are examples of an electronic module for use in the hearing aid of FIG. 1, FIGS. 8–10 show the design of a battery lid connected with the faceplate.
Figure 7:
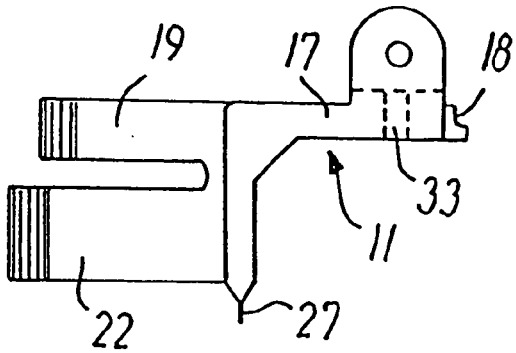

For engagement with the engaging means formed in the faceplate 2, the socket part 11 of the electronic module 4, as seen more clearly in FIGS. 6 and 7, is formed with sideways projecting ribs 17 for arrangement in the tracks 14 and 15, and with a cam-like, backward projection 18 for engagement with the notch 16, and with protruding resilient lugs 19 for localization in the grooves 12 and 13.

When the electronic module 4 is arranged in the faceplate 2 with the battery lid 3 pivoted out to the position shown in FIGS. 1 and 2, the parts of the electronic module intended for arrangement in the plug 1 under the faceplate 2, i.e., the signal processing part 6 and the telephone 7, are passed through the recess 8 down into the plug 1. The socket part 11 is then placed with the ribs 17 in the tracks 14 and 15 and is displaced in or pivoted towards the plane of the faceplate 2 so that the projection 18 is brought into engagement with the notch 16, whereby the resilient lugs 19 also engage with the grooves 12 and 13.

The engaging means at the edges of the recess 8 and the matching engaging means on the socket part 11 of the electronic module 4 may be formed so that the electronic module 4 is passed substantially at a right angle into the second region 10 of the recess 8 and is then displaced in the plane of the faceplate for provision of the engagements described above. Preferably, however, the socket part 11 is passed at an oblique angle into the recess 8 with abutment on its edge at the notch 16, whereupon the socket part is pivoted into place and fastened by engagement of the resilient lugs 19 with the grooves 12 and 13 and of the projection 18 with the notch 16. In this design, the end of the tracks 14, 15 and the corresponding ends of the ribs 17 may be formed for abutment on each other and for retention of the socket part 11 against displacement in the plane of the faceplate 2 after mounting of the socket part in the recess 8.

When the electronic module 4 is removed from the hearing aid, the resilient lugs 19 can be released from their engagement with the grooves 12 and 13 by means of a suitable tool, whereupon the socket part 11 is pivoted upwards with the back edge at the notch 16 as the pivot axis for release of the projection 18 from its engagement with the notch 16 so that the socket part 11 can be removed from the faceplate 2, and the other components 6 and 7 of the electronic module 4 can be lifted out from the interior of the plug 1 through the recess 8.

This design, where the socket part 11 can be pivoted in and out of its position is especially advantageous as the engaging means 12–16 of this design, apart from being formed compactly, do not require space for displacement of the socket part 11 into the region 9 at insertion and removal. The design at the same time still provides good retention of the socket part 11, as the resilient lugs 19 project into the region 9 for positioning of the battery and here act as levers that provide a strong fastening of the socket part and prevent its unintended pivoting out after the mounting. The relatively large distance whereby the resilient lugs 19 project into the region 9 at the same time makes it easy to remove the socket part 11, as by intention the lugs 19 can easily be pushed out of engagement by a relatively small use of force at the outer ends of the lugs 19.

Figure 4:
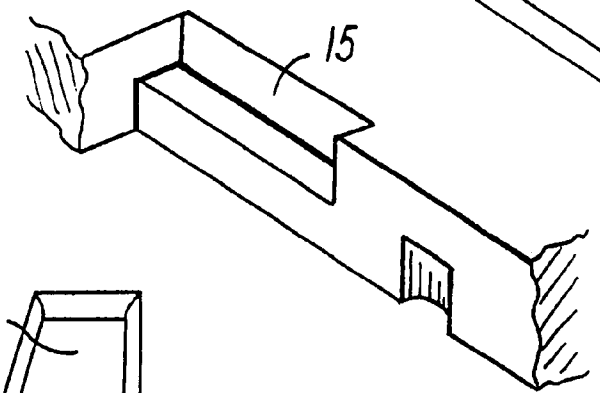
FIGS. 4 and 5 show details in the design of the faceplate.

FIG. 4 shows an alternative design of the engaging means at the edge of the recess 8, the grooves 12 and 13 being replaced by upwardly closed recesses 20. Another possibility is that the grooves 12 and 13 may open out downwards into groove tracks 13*a* which, as shown in FIG. 3, expand from the recess. This design provides good engagement of the resilient lugs 19 against unintended pivoting out of engagement.

Figure 5:
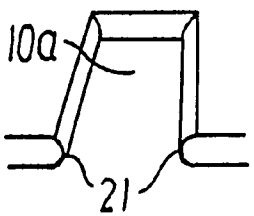

Another alternative design of the engaging means appears from FIG. 5, where the second region 10*a* of the recess 8 has a truncated wedge shape. The tracks 14 and 15 and the notch 16 are here replaced by inwardly projecting, arched ribs 21 at opposite edges of the recess 8, which retain the socket part 11 in both directions at right angles to the faceplate 2 by engagement with adapted grooves in the socket part 11 instead of the ribs 17.

As shown in FIGS. 6 and 7, the protruding resilient lugs 19 from the socket part 11 may suitably be formed with integral battery terminals 22, as after mounting of the socket part 11 these lugs project into the first region of the recess 8, where they can be contacted by the terminals on the battery 23 shown in FIG. 11, when it is swung into its operative position by closure of the pivotal lid 3.

In the embodiment shown, the pivotal battery lid 3 is hinge-connected to the socket part 11 of the electronic module 4 by the socket part being formed with hinge bearings 24 with holders for a pin 25 which can engage with hinge tracks 26 formed at one end of the battery lid 3.

To retain the battery 23, the battery lid 3 has a partially cylindrical wall 27 extending over at least 180E and defining a battery space 29 together with circular-section-shaped edge flanges 28. One terminal, usually the negative terminal on the battery 23, is formed as a pole button 30 as shown in FIG. 11, and the cylindrical wall 27 at one side of the battery lid 3 may be formed with an upright annular edge 31 which, at correct arrangement of the battery, encloses the pole button 30, but which, if the battery is turned the wrong way, causes the battery lid 3 to be non-closeable. This prevents insertion of the battery with an incorrect polarization. In the embodiment shown, where the battery lid 3 is formed with edge flanges 28 at both sides, the side of the edge flange 28 where the pole button 30 is placed is formed with a depression 32 providing room for the pole button.

When the battery lid 3 is closed, the circular-section-shaped edge flanges 28 abut on the exterior of the faceplate 2 around the recess 8, ensuring correct positioning of the battery 23 at its insertion into the first region 9 of the recess 8, while at the same time the faceplate 2 can be manufactured in a relatively simple standard design as a plane disc-shaped body without protruding abutment for the battery lid, whereby the manufacturing of the aggregate hearing aid is simplified and made cheaper, and mounting and removal of the components of the electronic module are facilitated.

Figure 8:
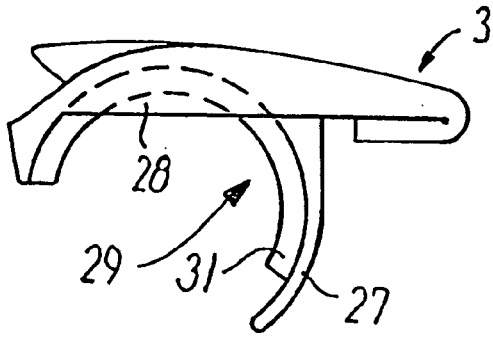
Figure 9:
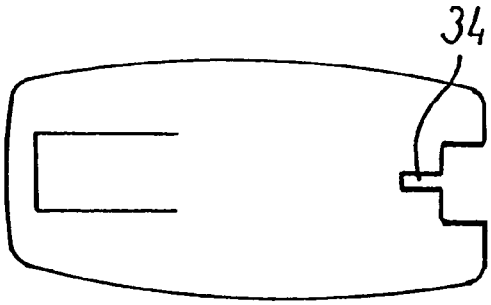
Figure 10:
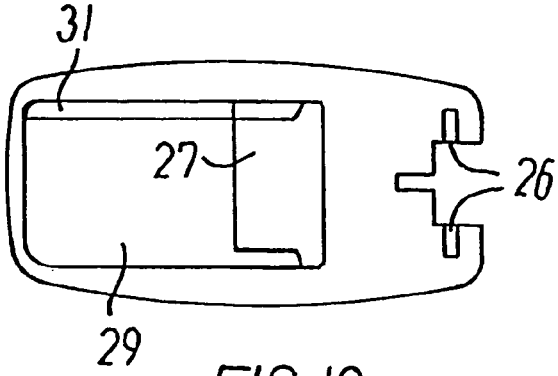

As it appears particularly from FIGS. 1, 2 and 8, the design of the battery lid results in retention of the battery 23 with uncovered battery terminals formed by the pole button 30 and the end surface of the battery opposite thereto so that at closure of the battery lid, the terminals are directly brought into contact with the integral battery terminals on the resilient lugs 19 on the socket part 11.

At the closure of the battery lid, the main part of the partially cylindrical wall 27 will furthermore be placed up against the socket part 11, while the remaining part of the circumferential surface of the battery is not enclosed by any socket that would take up space in the interior of the plug 1. The wall of the plug 1 can be located very close to the battery so that the plug can be formed with small dimensions.

In addition to causing accurate positioning and retention of the electronic module in relation to the faceplate 2, the design of the socket part 11 described above means that it supports the battery terminals 22 of the electronic module directly, and through the hinge connection with the battery lid it causes a secure guiding of the battery during closure of the battery lid.

In the electronic module, the microphone part 5, as it appears particularly from FIGS. 1, 2 and 6, is directly connected with the socket part 11 and communicates with the surroundings through microphone ports 33 and 34 formed in the socket part 11 and the battery lid 3, respectively, so that with a closed battery lid they correspond mutually to ensure well-defined sound access to the microphone part 5. In the embodiment shown, the microphone port 34 in the battery lid 3 is formed as an open slit which can relatively easily be cleaned at soiling through opening of the battery lid 3.

The signal processing part 6 with the amplifier circuit of the hearing aid is connected via flexible wires 35 to terminals 36 on the socket part 11, and correspondingly, the telephone 7 is connected with the signal processing part 6 via flexible wires 37. This allows the most suitable arrangement of the signal processing part 6 and the telephone 7 in the individually adapted plug 1.

The design described above of the modular hearing aid according to the invention with the individually adapted plug 1, the faceplate 2 fastened to the plug 1 and formed according to its contour, the battery lid 3 and its hinge connection with the socket part of the electronic module 4 allows an extremely expedient and economic manufacturing together with a very compact design that allows manufacturing of individually adapted ITE hearing aids of reduced dimensions, which it was formerly only possible to obtain with hearing aids of a standard design, i.e., without individual adaptation of the ear canal plug.

What is claimed is:

1. A method of manufacturing a hearing aid, comprising the steps of providing a shell, said shell being adapted to the ear canal of a user and having an outward opening, providing a faceplate, said faceplate having a recess, joining said faceplate to said shell to cover said outward opening and to define a housing, adapting an outer contour of said faceplate according to a contour of said shell, providing an electronic module, said electronic module having components for sound reception, signal processing and sound reproduction, and mounting said electronic module in said housing by passing at least part of said electronic module through said recess and into said housing and engaging said electronic module with said housing.

2. The method according to claim 1, wherein said electronic module is placed at least partially below said faceplate.

3. The method according to claim 1, comprising, after the step of adapting a contour and prior to the step of mounting said electronic module, the step of cleaning said housing.

4. The method according to claim 1, wherein the step of mounting said electronic module comprises passing a first part of the electronic module through said recess and into said shell, inserting a second part of said electronic module in said recess.

5. The method according to claim 4, comprising engaging said second part in said faceplate.

6. The method according to claim 4, comprising engaging said second part in said faceplate by resilient, releasable means.

7. The method according to claim 4, comprising engaging said second part in said faceplate by providing in said faceplate faceplate engagement means, providing in said second part resilient, projecting lugs, and engaging said lugs in said faceplate engagement means.

8. The method according to claim 4, comprising providing in said second part integral battery terminals.

9. The method according to claim 1, comprising providing a battery lid pivotally connected to said faceplate.

10. The method according to claim 4, comprising providing a battery lid pivotally connected to said second part.

11. The method according to claim 10, comprising providing in said second part a hinge pin, and providing in said battery lid hinge tracks for cooperative engagement with said pin.

12. The method according to claim 1, wherein said electronic module comprises a microphone, a signal processing part and a telephone.

13. The method according to claim 12, comprising connecting said microphone to said signal processing part via flexible wires.

14. The method according to claim 12, comprising connecting said signal processing part to said telephone via flexible wires.

15. The method according to claim 4, wherein said first part comprises a signal processing part.

16. The method according to claim 4, wherein said first part comprises a telephone.

17. The method according to claim 4, wherein said second part comprises a microphone.

18. The method according to claim 1, wherein said recess comprises a first region adapted for the insertion of a battery and a second region, contiguous with said first region, for receiving a socket part of said electronic module.

19. The method according to claim 18, wherein said recess is formed such that said first and second regions together allow passage of a signal processing part and a sound reproducer part.

20. A method of manufacturing a hearing aid housing, comprising the steps of providing a shell, said shell being adapted to the ear canal of a user and having an outward opening, providing a faceplate, said faceplate having a recess, said recess having a first region for the insertion of a battery and a second region contiguous with said first region for receiving a socket part of an electronic module, joining said faceplate to said shell to cover said outward opening and to define a housing, and adapting an outer con-tour of said faceplate according to a contour of said shell.

21. The method according to claim 20, comprising the step of cleaning said housing.

22. The method according to claim 20, comprising providing in said faceplate faceplate engagement means.

23. The method according to claim 20, comprising providing a battery lid pivotally connected to said faceplate.

24. The method according to claim 23, comprising providing in said battery lid hinge tracks for cooperative engagement with a hinge pin.

25. The method according to claim 20, wherein said recess is formed such that said first and second regions together allow passage of a signal processing part and a sound reproducer part.

26. The method according to claim 20, wherein the step of adapting an outer contour comprises forming by cutting or milling.

27. The method according to claim 20, comprising providing in said shell a sound exit hole.

28. The method according to claim 20, wherein the step of joining comprises gluing said faceplate to said shell.

* * * * *